US005119143A

United States Patent [19]

Shimura

[11] Patent Number: 5,119,143

[45] Date of Patent: Jun. 2, 1992

[54] ENDLESS FIXING FILM WITH A RIB AND ADHESIVE LAYER

[75] Inventor: Shoichi Shimura, Yokohama, Japan

[73] Assignee: Canon Kabushiki Kaisha, Tokyo, Japan

[21] Appl. No.: 669,469

[22] Filed: Mar. 14, 1991

[30] Foreign Application Priority Data

Mar. 16, 1990 [JP] Japan ..... 2-066106

[51] Int. Cl.[5] ..... G03G 15/20

[52] U.S. Cl. ..... 355/289; 219/216; 432/59; 156/324

[58] Field of Search ..... 355/212, 271, 285, 289, 355/290; 269/216; 432/59, 60; 198/835, 840; 474/237; 156/137, 138, 324

[56] References Cited

U.S. PATENT DOCUMENTS 3,811,828 5/1974 Ohta et al. ..... 219/216 y
4,998,121 3/1991 Koh et al. ..... 346/160
5,017,969 5/1991 Mitomi et al. ..... 355/271

*Primary Examiner*—Joan H. Penedegrass
*Attorney, Agent, or Firm*—Fitzpartrick, Cella, Harper & Scinto

[57] ABSTRACT

An endless film includes an endless film member; a rib having a JIS A hardness of not more than 100 degrees; an an adhesive layer between the film and the rib, the adhesive layer having a JIS A hardness after being cured.

17 Claims, 3 Drawing Sheets

ENDLESS FIXING FILM WITH A RIB AND ADHESIVE LAYER

FIELD OF THE INVENTION AND RELATED ART

The present invention relates to an endless film and a heating apparatus using the same, usable with an image forming apparatus such as a copying machine or photoprinter to fix an unfixed image or to improve the surface property of the image.

A widely used image fixing system for fixing a toner image on a recording material has the recording material passed through a nip formed between a heating roller and a pressing roller, that is, a heat-roller type fixing system.

However, the heat-roller type fixing system involves a problem that the time required for warming the apparatus up to a predetermined temperature is long.

U.S. Ser. Nos. 206,767, 387,970, 409,341, 416,539, 426,082, 435,247, 430,437, 440,380, 440,678, 444,802 and 446,449, which have been assigned to the assignee of this application have proposed an image fixing apparatus using a thin endless film, so that the warming-up period is eliminated or significantly reduced.

However, if such an endless film is used, the film tends to shift laterally, that is, shift in the direction perpendicular to the film travel.

It has been considered that a rib or ribs are provided at a lateral end or ends may confine the lateral shifting tendency.

However, the use of the rib still involves problems. When the film is used with tension applied thereto by rollers, the curvature becomes locally small. If the rib is bonded on the film, the rib is peeled off the film where the curvature is small, or the rib does not deform in compliance with the curvature with the result of stress applied to the film beyond the tensile strength of the film with the result of tearing it.

SUMMARY OF THE INVENTION

Accordingly, it is a principal object of the present invention to provide an endless film with a rib which is not easily peeled off.

It is another object of the present invention to provide an endless film with a rib, which is not easily torn.

According to an aspect of the present invention, there is provided an endless film to which a rib having a JIS (Japanese Industrial Standard) A hardness of not more than 100 degrees with a bonding agent having a JIS A hardness of more than 100 degrees after curing.

According to another aspect of the present invention, there is provided a heating apparatus comprising a film provided with a rib having a JIS A hardness of not more than 100 degrees bonded with a bonding agent having a JIS A hardness of not more than 100 degrees.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Figure 1:
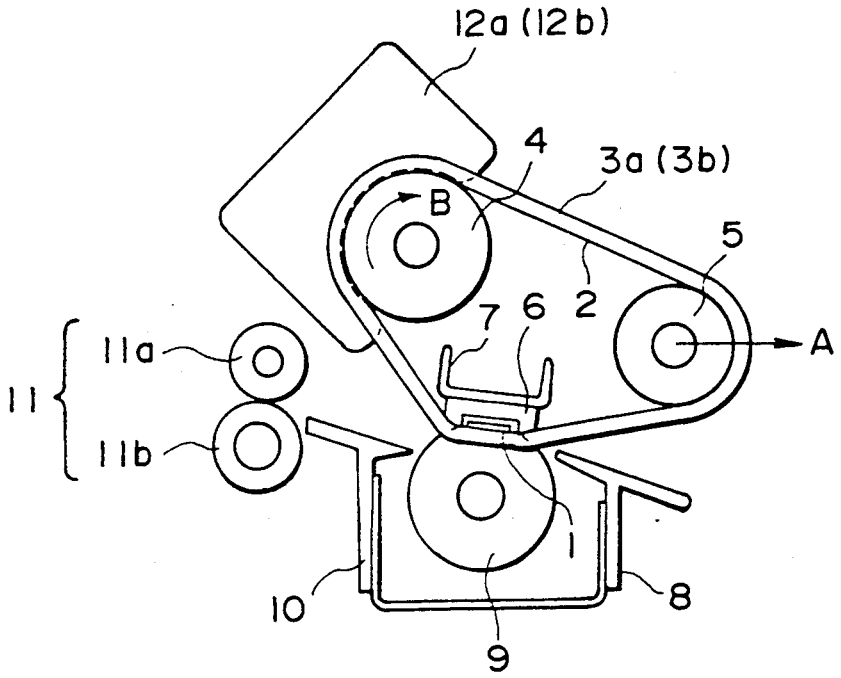
FIG. 1 is a sectional view of an image fixing apparatus according to an embodiment of the present invention.

Referring to FIG. 1, there is shown a heat-fixing apparatus according to an embodiment of the present invention. The fixing apparatus comprises a low thermal capacity linear heater 1 which is stationary in use. The heater includes an aluminum base plate having a high thermal conductivity and an electric resistance material applied thereon. It generates heat upon power supply thereto. The resistance material is connected to an electric energy supply source at longitudinal opposite ends. The heater 1 is fixed by a low thermal conductivity insulating member (holder) 6 and a supporting member 7 having sufficient rigidity. The power supply is in the form of a pulse wave of DC 100 V with the period of 20 msec, for example. The temperature is detected by a temperature sensor, and the controlled pulse energy is supplied in accordance with the amount of energy emission. Generally, the pulsewidth ranges between 0.5–5 msec.

On the heater 1 thus temperature-controlled, a fixing film 2 moves in the direction indicated by an arrow B. The film comprises a heat-resistive resin having a thickness of approximately 20 microns, in the form of a thin endless film. The base member is preferably made of polyethylene terephthalate, polyphenylene sulfide, liquid crystal aromatic polyester resin, polyether ether ketone, polysulfone, polyether sulfone, polyether imide, polyimide or the like. From the standpoint of preventing toner offset, it is preferable for the heat resistive resin base to be coated with a thin parting layer of fluorinated resin such as polytetrafluoroethylene having increased electric conductivity by dispersing carbon or the like therein. The coating is outside the base material. Here, the part or parts of the resin base at which a rib or ribs which will be described hereinafter are bonded, are not coated with the parting layer, from the standpoint of increasing the bonding strength between the rib and the endless film.

In order to provide sufficient thermal transfer from the heater, the total thickness of the film is generally preferable if it is smaller than 50 microns. The ribs **3*a* and 3*b* are made of rubber or thermo-plastic elastomer material and are bonded to the film 2** with a bonding agent or adhesive material.

The usable materials of the rib include styrene butadiene rubber, nitrile rubber, chloroprene rubber, ethylenepropylene terpolymer, butyl rubber, isoprene rubber, silicone rubber or another rubber material, and include styrene thermo-plastic elastomer, olefin thermoplastic elastomer, polychloride vinyl thermo-plastic elastomer, urethane thermo-plastic elastomer, polyester thermo-plastic elastomer, polyamide thermo-plastic elastomer, fluorine thermo-plastic elastomer, chlorinated polyethylene thermo-plastic elastomer, or another thermo-plastic elastomer.

The usable bonding materials include a rubber bonding agent such as neoprene or chloroprene bonding agent, melamine resin bonding agent, phenol resin bonding agent, epoxy bonding agent, vinylacetate bonding agent, ethylenevinylacetate bonding agent, cyanoacrylate bonding agent and polyurethane bonding agent.

The fixing film 2 is stretched around a driving roller 4 and a follower roller 5 which cooperate with the heater 1 to constitute a film travel path.

The fixing film 2 is stretched by urging the follower roller 5 in the direction of an arrow A, and is moved in the direction B by the driving roller 4.

The pressing roller 9 is supported by unshown bearing to rotate following the film 2 travel. It urges the film 2 to the heater 1 with a total pressure of 4-7 kg, so that it is rotated in press-contact to the heater 1.

Figure 2:
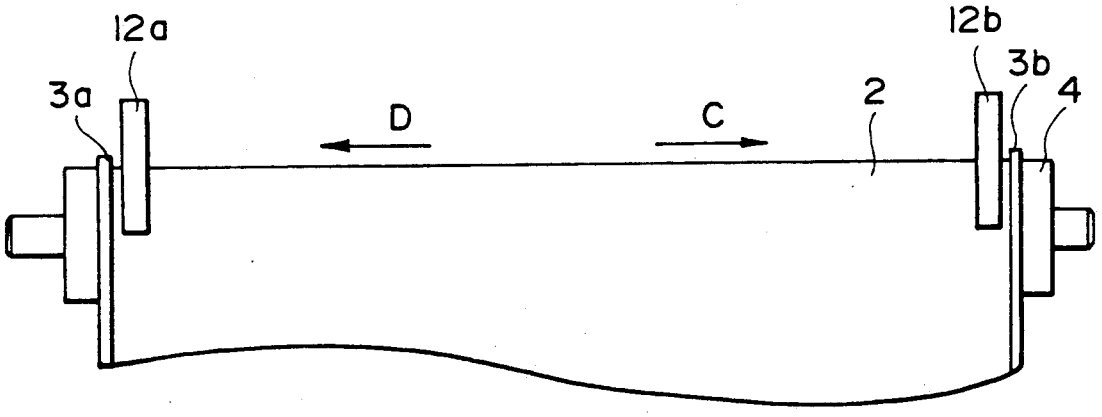
FIG. 2 is a top plan view of the image fixing apparatus of FIG. 1.

FIG. 2 is a top plan view of the apparatus of FIG. 1. Confining members 12A and 12B are provided along an outer periphery of the driving roller 4 at the insides of the ribs 3*a* and 3*b* to confine the ribs 3*a* and 3*b*. Even if the film 2 tends to laterally shift in a direction indicated by an arrow C, for example, the rib 3*a* abuts the confining member 12*a*, so that the lateral shift stops. On the contrary, if the film tends to shift in a direction D, the rib 3*b* is confined by the confining member 12*b*, so that the lateral shift in this detection stops.

With the above structure, an unshown recording sheet is passed along an inlet guide 8 and is introduced into the nip formed between the film 2 and the pressing roller 9. In the nip, the toner image on the recording material is heated and fused by the heat and the pressure provided by the heater 1 and the pressing roller 9, by which the toner image is fixed on the recording material. The recording material now having the fixed image is discharged to the outside of the apparatus by sheet discharging rollers 11 along a separation guide 10.

The description will be made as to the ribs at the lateral ends of the film.

EXAMPLE 1

Film: Polyimide material, not coated with polytetrafluoroethylene resin at outer peripheries at the lateral end portions to which the ribs were bonded.

Rib: Polyurethane material having JIS A hardness of 80 degrees.

Adhesive: Epoxy adhesive having JIS A hardness of 86 degrees after being cured.

The film was incorporated in the fixing apparatus of FIG. 1, and the recording materials were continuously processed to fix the images thereon. As a result, it was confirmed that the lateral shift of the film was effectively prevented without peeling of the ribs and without tearing of the film.

EXAMPLE 2

Film: Same as with Example 1.

Rib: Polyurethane material having JIS A hardness of 90 degrees.

Adhesive Same as with Example 1.

The film was incorporated in the fixing apparatus of FIG. 1, and the recording materials were continuously processed to fix the images thereon. As a result, it was confirmed that the lateral shift of the film was effectively prevented without peeling of the ribs and without tearing of the film, similarly to Example 1.

EXAMPLE 3

Film: Same as with Example 1.

Rib: Polyurethane material having JIS A hardness of 100 degrees

Adhesive: Same as with Example 1.

The film was incorporated in the fixing apparatus of FIG. 1, and the recording materials were continuously processed to fix the images thereon. As a result, it was confirmed that the lateral shift of the film was effectively prevented without peeling of the ribs and without tearing of the film, similarly to Example 1.

EXAMPLE 4

Film: Same as with Example 1.

Rib: EPDM material having JIS A hardness of 100 degrees.

Adhesive: Same as with Example 1.

The film was incorporated in the fixing apparatus of FIG. 1, and the recording materials were continuously processed to fix the images thereon. As a result, it was confirmed that the lateral shift of the film was effectively prevented without peeling of the ribs and without tearing of the film, similarly to Example 1.

EXAMPLE 5

Film: Polyethersulfone material not coated with polytetrafluoroethylene resin at outer peripheries at the lateral end portions to which the ribs were bonded.

Rib: Polyurethane material having JIS A hardness of 100 degrees.

Adhesive: Same as with Example 1.

The film was incorporated in the fixing apparatus of FIG. 1, and the recording materials were continuously processed to fix the images thereon. As a result, it was confirmed that the lateral shift of the film was effective prevented without peeling of the ribs and without tearing of the film.

COMPARISON EXAMPLE 1

Film: Same as with Example 1.

Polyurethane material having JIS A hardness of 110 degrees

Adhesive: Epoxy adhesive having JIS A hardness of 86 degrees after being cured, as in Example 1.

The film was incorporated in the fixing apparatus of FIG. 1, and the recording materials were continuously processed to fix the images thereon. The rib or ribs were peeled off the film in several hours, with the result of the lateral shift was not controllable.

COMPARISON EXAMPLE 2

Film: Same as with Example 1.

Rib: EPDM material having JIS A hardness of 110 degrees.

Adhesive: Same as with Example 1.

The film was incorporated in the fixing apparatus of FIG. 1, and the recording materials were continuously processed to fix the images thereon. The rib or ribs were peeled off the film in several hours, with the result that the lateral shift of the film was not controllable.

COMPARISON EXAMPLE 3

Film: Same as with Example 5.

Rib: Polyurethane material having JIS A hardness of 110 degrees.

Adhesive: Same as with Example 1.

The film was incorporated in the fixing apparatus of FIG. 1, and the recording materials were continuously processed to fix the images thereon. The film was torn.

The result of the above experiments were summarized in Table 1 below.

TABLE 1

| | Film material | Rib Material | Rib JISA hardness | Rib Peeling of rib | Rib Tearing of film |
|---|---|---|---|---|---|
| Example 1 | Polyimide | Polyurethane | 80 | No | No |
| Example 2 | Polyimide | Polyurethane | 90 | No | No |
| Example 3 | Polyimide | Polyurethane | 100 | No | No |
| Example 4 | Polyimide | EPDM | 100 | No | No |
| Example 5 | Polyether-sulfone | Polyurethane | 100 | No | No |
| Com Example 1 | Polyimide | Polyurethane | 110 | Yes | No |
| Com Example 2 | Polyimide | EPDM | 110 | Yes | No |
| Com Example 3 | Polyether-sulfone | Polyurethane | 110 | No | Yes |

As will be understood from the Table, the peeling of the rib and the tearing of the film can be prevented by using, as the material of the rib, rubber or thermo-plastic elastomer material having JIS A hardness of 100 degrees or less.

The inventor has found that the hardness of the adhesive is significantly influential to the durability of the film. Experiments have been conducted with a variety of hardness of the adhesive.

EXAMPLE 6

Film: Polyimide material (not coated with polytetrafluoroethylene resin at outer peripheries at the lateral end portions to which the ribs are bonded.

Rib: Polyurethane material having JIS A hardness of 90 degrees.

Adhesive: Epoxy adhesive having JIS A hardness of 78 degrees after being cured.

The film was incorporated in the fixing apparatus of FIG. 1, and the recording materials were continuously processed to fix the images thereon. As a result, it was confirmed that the lateral shift of the film was effectively prevented without peeling of the ribs and without tearing of the film.

EXAMPLE 7

Film: Same as with Example 6.

Rib: Same as with Example 6.

Adhesive: Epoxy adhesive having JIS A hardness of 92 degrees after being cured.

The film was incorporated in the fixing apparatus of FIG. 1, and the recording materials were continuously processed to fix the images thereon. As a result, it was confirmed that the lateral shift of the film as effectively prevented without peeling of the ribs and without tearing of the film.

EXAMPLE 9

Film: Same as with Example 6.

Rib: Same as with Example 6.

Adhesive: Epoxy adhesive having JIS A hardness of 98 degrees after being cured.

The film was incorporated in the fixing apparatus of FIG. 1, and the recording materials were continuously processed to fix the images thereon. As a result, it was confirmed that the lateral shift of the film was effectively prevented without peeling of the ribs and without tearing of the film.

EXAMPLE 9

Film: Same as with Example 6.

Rib: Same as with Example 6.

Adhesive: Polyurethane adhesive having JIS A hardness of 95 degrees after being cured.

The film was incorporated in the fixing apparatus of FIG. 1, and the recording materials were continuously processed to fix the images thereon. As a result, it was confirmed that the lateral shift of the film was effectively prevented without peeling of the ribs and without tearing of the film.

EXAMPLE 10

Film: Polyethersulfone material, not coated with polytetrafluoroethylene resin at outer peripheries at the lateral ends portions to which the ribs are bonded.

Rib: Same as with Example 6.

Adhesive: Epoxy adhesive having JIS A hardness of 98 degrees after being cured.

The film was incorporated in the fixing apparatus of FIG. 1, and the recording materials were continuously processed to fix the image thereon. As a result, it was confirmed that the lateral shift of the film was effectively prevented without peeling of the ribs and without tearing of the film.

COMPARISON EXAMPLE 4

Film: Same as with Example 6.

Rib: Same as with Example 6.

Adhesive: Epoxy adhesive having JIS A hardness of 105 degrees after being cured.

The film was incorporated in the fixing apparatus of FIG. 1, and the recording materials were continuously processed to fix the images thereon. The rib or ribs were peeled off the film in several hours, with the result that the lateral shift of the film was not controllable.

COMPARISON EXAMPLE 5

Film: Same as with Example 6.

Rib: Same as with Example 6.

Adhesive: Polyurethane adhesive having JIS A hardness of 110 degrees after being cured.

The film as incorporated in the fixing apparatus of FIG. 1, and the recording materials were continuously processed to fix the images thereon. The rib or ribs were peeled off the film in several hours, with the result that the lateral shift of the film was not controllable.

COMPARISON EXAMPLE 6

Film: Same as with Example 10.

Rib: Same as with Example 10.

Adhesive: Epoxy adhesive having JIS A hardness of 105 degrees after being cured.

The film was incorporated in the fixing apparatus of FIG. 1, and the recording materials were continuously processed to fix the images thereon. The film was torn.

The above experiments of Examples 6–10 and Comparison Examples 4–6 are summarized in the following Table 2.

TABLE 2

| | Film material | Rib Material | JISA hardness | Peeling of rib | Tearing of film |
|---|---|---|---|---|---|
| Example 6 | Polyimide | Epoxy | 78 | No | No |
| Example 7 | Polyimide | Epoxy | 92 | No | No |
| Example 8 | Polyimide | Epoxy | 98 | No | No |
| Example 9 | Polyimide | Polyurethane | 95 | No | No |
| Example 10 | Polyether-sulfone | Epoxy | 98 | No | No |
| Com. Example 4 | Polyimide | Epoxy | 105 | Yes | No |
| Com. Example 5 | Polyimide | Polyurethane | 110 | Yes | No |
| Com. Example 6 | Polyether-sulfone | Epoxy | 105 | No | Yes |

As will be understood from the above experiments, a very long service life is obtained if the rib is made of a material having JIS A hardness of 100 degrees or less and if the adhesive used has a JIS A hardness of 100 degrees or less after being cured.

Figure 3:
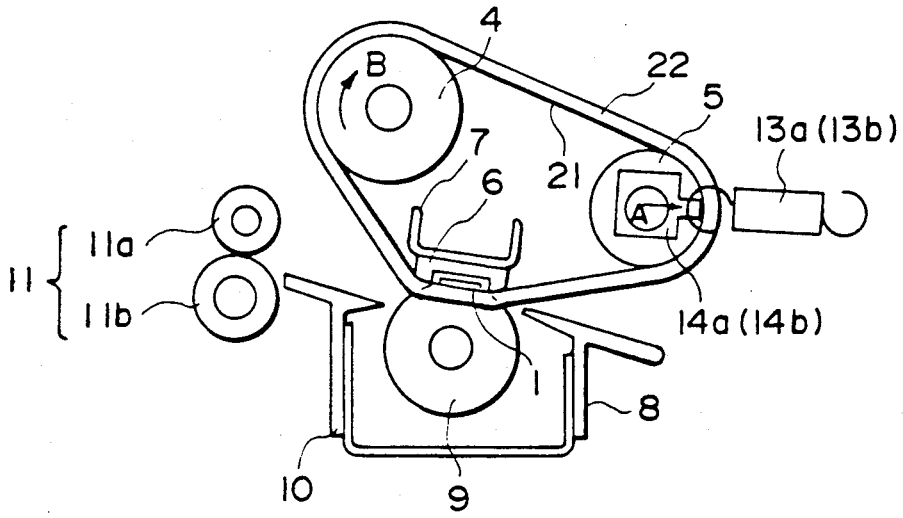
FIG. 3 is a sectional view of an image fixing apparatus according to another embodiment of the present invention.

Referring to FIG. 3, the description will be made as to another embodiment of the present invention wherein the lateral shift of the endless film is also confined.

FIG. 3 is a sectional view of an image fixing apparatus of this embodiment wherein the lateral shift of the film is detected using the rib at the end of the film, in order to suppress the lateral shift of the film.

Figure 4:
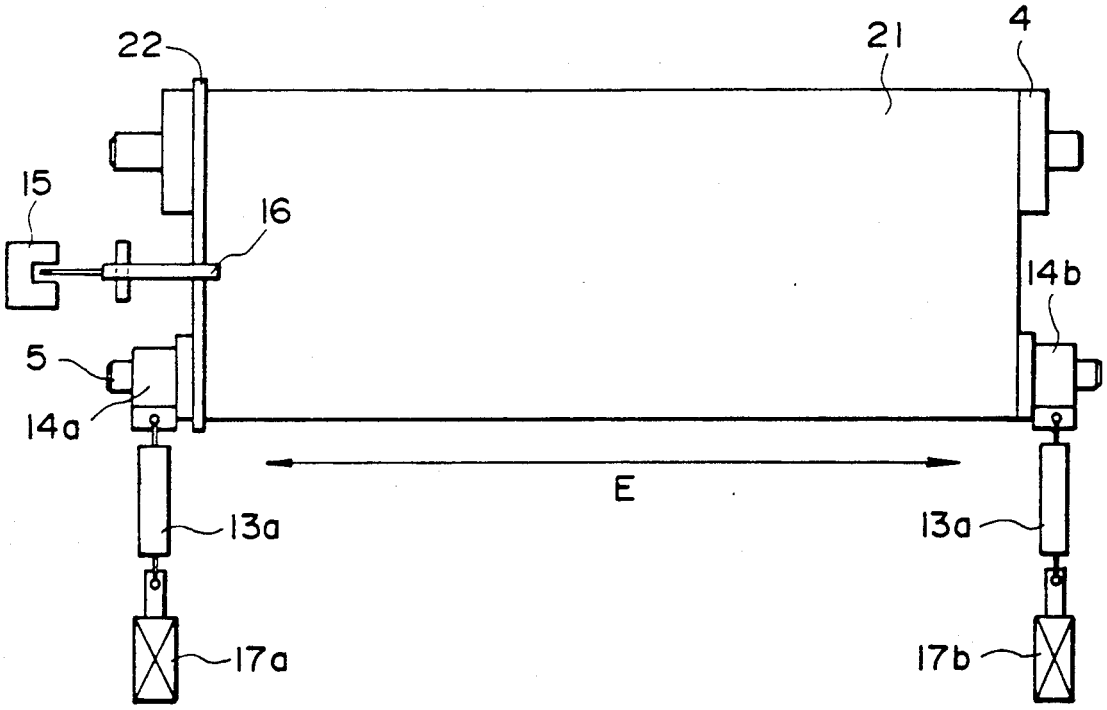
FIG. 4 is a perspective view of the apparatus of FIG. 3, as seen from upper right side.

FIG. 4 is a perspective view of the apparatus of FIG. 3, as seen from upper right side.

Figure 5:
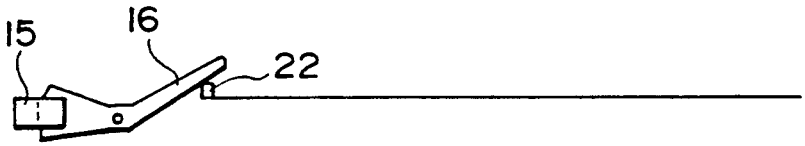
FIG. 5 is a perspective view of the apparatus of FIG. 3, as seen from left side.

FIG. 5 is a right side view of the apparatus of FIG. 3. A lever 16 functioning as an actuator for the sensor 15 is contacted to a part of the rib 22 on the film 21. If the film 21 is shifted laterally in the direction of an arrow E, the lever 16 rotates to actuate or deactuate the sensor. In response to the output of the sensor, solenoids 17A and 17B are energized or deenergized, thus controlling the urging force applied by the urging means 13*a* and 13*b*. In this manner, the lateral shift direction can be changed to assure the control.

In the case of the fixing apparatus of this structure, the fixing film having the rib made of the material having JIS A hardness of 100 degrees or less, as in the embodiment of FIG. 1, which is bonded thereto with an adhesive having a JIS A hardness of 100 degrees or less after being cured was effective, because the detection of the lateral shift of the film was assured without peeling of the rib and the tearing of the film.

Figure 6:
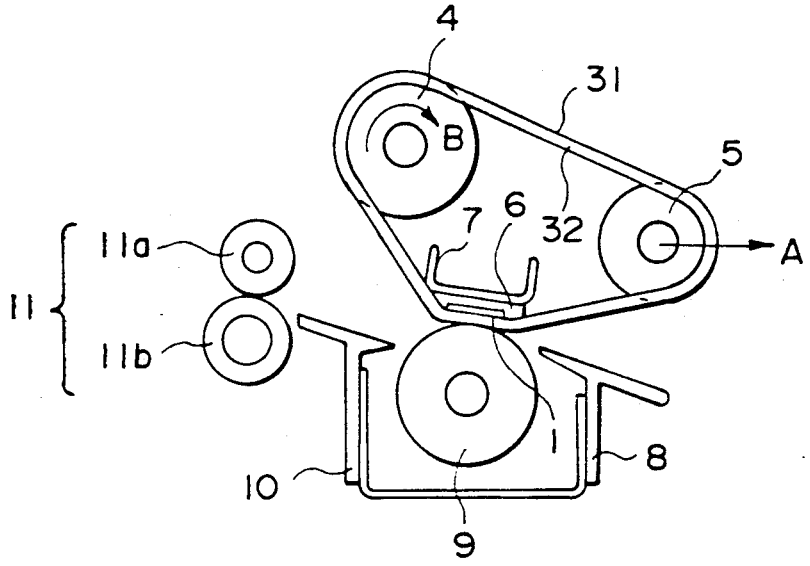
FIG. 6 is a sectional view of an image fixing apparatus according to a further embodiment of the present invention.
Figure 7:
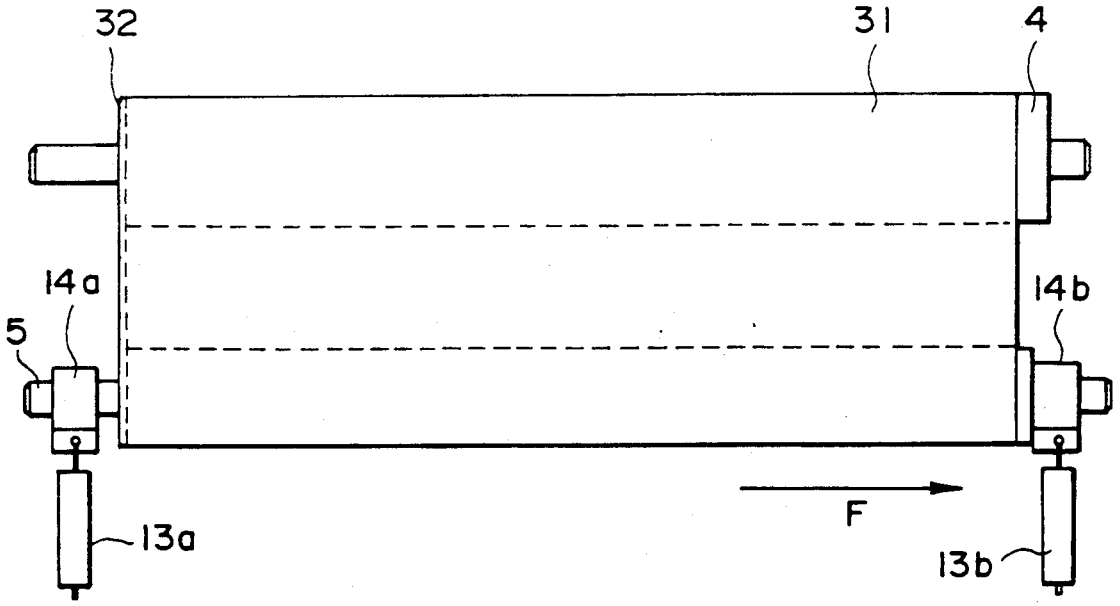
FIG. 7 is a perspective view of the apparatus of FIG. 6, as seen from upper right side.

FIG. 6 is a sectional view of an image fixing apparatus of another type wherein the rib is confined to prevent the lateral shifting of the film. The rib 32 is formed on an inside surface of the fixing film 31 and at one lateral end. FIG. 7 is a perspective view of the apparatus of FIG. 6, as seen from the film 31 is stretched by urging the tension roller 5 in the direction A by urging means 13*a* and 13*b*, and is conveyed in a direction B by a driving roller 4.

The film 31 always receives a lateral shifting force in a direction indicated by an arrow F during its travel, by adjusting the inclination or inclinations of the rollers 4 and/or 5 or the like or by adjusting the urging force by the urging means 13*a* and 13*b*. The rib 32 is abutted to the end surfaces of the driving roller 4, the tension roller 5 and the insulative member 6, so that the film is not shifted in the direction F.

In this fixing apparatus, the film having the rib of the material having a JIS A hardness of 100 degrees or less which is bonded thereto with an adhesive having a JIS A hardness of 100 degrees or less after being cured, as in FIG. 1 embodiment, is effectively used, since the lateral shifting of the film can be prevented without peeling of the rib and the tearing of the film.

As described in the foregoing, according to the present invention, the rib is prevented from being peeled off the film, and the film is prevented from being torn, and therefore, the lateral shift of the film can be stably controlled and regulated in a long period of time.

While the invention has been described with reference to the structures disclosed herein, it is not confined to the details set forth and this application is intended to cover such modifications or changes as may come within the purposes of the improvements or the scope of the following claims:

What is claimed is:

1. An endless film, comprising:

an endless film member;

a rib having a JIS A hardness of not more than 100 degrees; and an adhesive layer between said film and said rib, said adhesive layer having a JIS A hardness of not more than 100 degrees after being cured.

2. A film according to claim 1, wherein said rib is made of rubber material.

3. A film according to claim 2, wherein said rubber material is urethane rubber material.

4. A film according to claim 1, wherein said rib is of thermo-plastic elastomer.

5. A film according to claim 4, wherein the elastomer is of EPDM (ethylenepropylenediene tercopolymer).

6. A film according to claim 1, wherein said film is of polyimide at its surface adhered to said rib.

7. A heating apparatus, comprising:

a heater;

an endless film movable together with a recording material carrying a visualized image, wherein the visualized image being heated by heat from said heater through said film;

a rib bonded to said endless film with an adhesive, said rib having a JIS A hardness of not more than 100 degrees;

wherein the adhesive has a JIS A hardness of not more than 100 degrees after it is cured.

8. An apparatus according to claim 7, wherein said rib is made of rubber material.

9. An apparatus according to claim 8, wherein said rubber material is urethane rubber material.

10. An apparatus according to claim 7, wherein said rib is of thermo-plastic elastomer.

11. An apparatus according to claim 10, wherein the elastomer is of EPDM (ethylenepropylenediene tercopolymer).

12. An apparatus according to claim 7, wherein said film is of polyimide at its surface adhered to said rib.

13. An apparatus according to claim 7, wherein a lateral shift of said endless film is prevented by said rib.

14. An apparatus according to claim 13, wherein said rib is provided at each of lateral ends of said endless film.

15. An apparatus according to claim 13, wherein said rib is provided only at one lateral side of said endless film.

16. An apparatus according to claim 13, wherein said rib is on an outer periphery of said endless film.

17. An apparatus according to claim 13, wherein said rib is on an inside surface of said endless film.

* * * * *

UNITED STATES PATENT AND TRADEMARK OFFICE

CERTIFICATE OF CORRECTION

PATENT NO. : 5,119,143

DATED : June 2, 1992

INVENTOR(S) : Shoichi SHIMURA

It is certified that error appears in the above-identified patent and that said Letters Patent is hereby corrected as shown below:

ON THE TITLE PAGE:

[56] REFERENCES CITED

PE, "Joan H. Penedegrass" should be --Joan H. Pendegrass--.

[57] ABSTRACT

Line 3, "an an" should read --and an--.

COLUMN 1

Line 30, "are" should be deleted.

COLUMN 3

Line 30, "detection" should read --direction--.

COLUMN 4

Line 44, "Polyurethane" should read --Rib: Polyurethane--.

COLUMN 5

Line 34, "(not" should read --not--;
Line 56, "as" should read --was--; and
Line 59, "EXAMPLE 9" should read --EXAMPLE 8--.

UNITED STATES PATENT AND TRADEMARK OFFICE

CERTIFICATE OF CORRECTION

PATENT NO. : 5,119,143

DATED : June 2, 1992

INVENTOR(S) : Shoichi SHIMURA

It is certified that error appears in the above-indentified patent and that said Letters Patent is hereby corrected as shown below:

COLUMN 6

Line 50, "as" should read --was--.

Signed and Sealed this

Thirty-first Day of August, 1993

Bruce Lehman

*Attest:*

BRUCE LEHMAN

*Attesting Officer*

*Commissioner of Patents and Trademarks*